US009875866B2

(12) United States Patent
Liao et al.

(10) Patent No.: US 9,875,866 B2
(45) Date of Patent: Jan. 23, 2018

(54) HAPTIC KEYSWITCH STRUCTURE AND INPUT DEVICE

(71) Applicants: DARFON ELECTRONICS (SUZHOU) CO., LTD., Suzhou (CN); DARFON ELECTRONICS CORP., Taoyuan County (TW)

(72) Inventors: Rui-Ming Liao, Taoyuan County (TW); Chih-Ho Hsu, Taoyuan County (TW)

(73) Assignees: DARFON ELECTRONICS (SUZHOU) CO., LTD., Suzhou (CN); DARFON ELECTRONICS CORP., Taoyuan County (TW)

( * ) Notice: Subject to any disclaimer, the term of this patent is extended or adjusted under 35 U.S.C. 154(b) by 0 days.

(21) Appl. No.: 15/173,156

(22) Filed: Jun. 3, 2016

(65) Prior Publication Data

US 2016/0358725 A1 Dec. 8, 2016

(30) Foreign Application Priority Data

Jun. 5, 2015 (TW) ..... 104118375 A

(51) Int. Cl.
*H01H 13/14* (2006.01)
*H01H 13/85* (2006.01)

(52) U.S. Cl.
CPC ..... *H01H 13/85* (2013.01); *H01H 2207/00* (2013.01); *H01H 2211/004* (2013.01); *H01H 2215/05* (2013.01); *H01H 2215/052* (2013.01); *H01H 2219/028* (2013.01); *H01H 2221/064* (2013.01); *H01H 2239/03* (2013.01)

(58) Field of Classification Search
CPC ..... H01H 13/85; H01H 2003/008; H03K 2217/96062; H03K 17/9645; G06F 3/016; G06F 3/0202; G06F 1/1662
USPC ..... 200/521; 341/27; 340/407.2, 384.6
See application file for complete search history.

(56) References Cited

U.S. PATENT DOCUMENTS 4,071,718 A 1/1978 Harden
7,952,261 B2 * 5/2011 Lipton ..... G06F 3/016 310/328
8,576,446 B2 11/2013 Tian et al.
(Continued)

FOREIGN PATENT DOCUMENTS

CN 101174511 A 5/2008
CN 101477911 7/2009
(Continued)

OTHER PUBLICATIONS

Taiwan Office Action dated May 4, 2016 from related Taiwan Patent Application No. 104118372, 10 pages.
(Continued)

*Primary Examiner* — Vanessa Girardi
(74) *Attorney, Agent, or Firm* — Innovation Capital Law Group, LLP; Vic Lin

(57) ABSTRACT

A keyswitch structure includes a keycap layer having a keycap region and a peripheral region adjacent to the keycap region, a circuit layer disposed under the keycap layer, a haptic actuator electrically connected to the circuit layer, a supporting structure layer being disposed under the circuit layer and having an accommodation space for accommodating the haptic actuator, and an adhesive layer disposed between the keycap layer and the circuit layer corresponding to only the peripheral region.

12 Claims, 13 Drawing Sheets

(56) References Cited

U.S. PATENT DOCUMENTS

| | | | | |
|---|---|---|---|---|
| 8,953,779 | B2 | 2/2015 | Tuovinen | |
| 9,576,446 | B2 * | 2/2017 | Zellers | G06F 3/016 |
| 2014/0062683 | A1 * | 3/2014 | Liu | G06F 3/016<br>340/407.2 |
| 2015/0091414 | A1 | 4/2015 | Korhonen et al. | |
| 2015/0205355 | A1 * | 7/2015 | Yairi | G06F 3/016<br>345/173 |

FOREIGN PATENT DOCUMENTS

| | | | |
|---|---|---|---|
| CN | 104396040 | A | 3/2015 |
| CN | 104681334 | A | 6/2015 |
| CN | 104701053 | A | 6/2015 |
| TW | 2007039399 | | 10/2007 |
| TW | 201432765 | | 8/2014 |
| TW | M490647 | | 11/2014 |
| TW | 201503192 | A | 1/2015 |
| TW | 201505060 | | 2/2015 |

OTHER PUBLICATIONS

Office Action dated May 16, 2017 from related U.S. Appl. No. 15/172,560, 16 pages.

* cited by examiner

HAPTIC KEYSWITCH STRUCTURE AND INPUT DEVICE

BACKGROUND OF THE INVENTION

1. Field of the Invention

The invention generally relates to a keyswitch structure. Particularly, the invention relates to a keyswitch structure and an input device having the keyswitch structure that can reduce the energy consumption of haptic feedback.

2. Description of the Prior Art

As the thinning requirement becomes more and more critical, the height of keyswitch structure is significantly decreased. Accordingly, the mechanical keyswitch is designed to have a shorter keystroke or gradually substituted by the touch type keyswitch. However, the keyswitch with shorter keystroke or the touch type keyswitch cannot provide effective force feedback during operation, and the user generally has difficulty to ensure whether the pressing manipulation is completed or not.

Current keyboard with the force feedback function generally includes a vibrator to transmit the vibratile wave to the corresponding keyswitch. However, the addition of vibrator or the integration of vibrator with the keyswitch complicates the circuit design and the support structure, less favorable to the thinning requirement. Moreover, the portable device, such as flat computer or smart phone, may provide vibration feedback when the user touches the screen to confirm the pressing operation is completed. However, this kind of vibration feedback is achieved by vibrating the portable device itself or the entire surface of the portable device, instead of providing independent and local haptic feedback, resulting in high energy loss during vibration.

Therefore, how to effectively provide the haptic feedback without compromising the thinning requirement is one of the major considerations for keyswitch design.

SUMMARY OF THE INVENTION

In view of the prior arts, it is an object of the invention to provide a keyswitch structure and an input device having the keyswitch structure to provide independent and local haptic feedback and reduce the energy consumption of the feedback.

It is another object of the invention to provide a keyswitch structure and an input device having the keyswitch structure that has the keycap layer designed based on requirements to enhance the vibration effect, improve the external appearance, promote the operation convenience, or reduce the cost.

In an embodiment, the invention provides a keyswitch structure including a keycap layer, a circuit layer, a haptic actuator, a supporting structure layer, and an adhesive layer. The keycap layer has a keycap region and a peripheral region adjacent to the keycap region. The circuit layer is disposed under the keycap layer. The haptic actuator is electrically connected to the circuit layer. The supporting structure layer is disposed under the circuit layer. The supporting structure layer has an accommodation space for accommodating the haptic actuator. The adhesive layer is disposed between the keycap layer and the circuit layer corresponding to only the peripheral region.

In an embodiment, the thickness of the keycap layer at the keycap region is larger than the thickness of the keycap layer at the peripheral region.

In an embodiment, the keycap layer has a recessed groove formed on a lower surface of the keycap layer corresponding to the keycap region; a filling material different from the material of the keycap layer fills in the recessed groove.

In an embodiment, the keycap layer has a positioning portion formed on a lower surface of the keycap layer corresponding to the keycap region. The circuit layer has a positioning hole. The positioning portion protrudes from the lower surface of the keycap layer to be positioned in the positioning hole.

In an embodiment, the positioning portion protrudes from the lower surface of the keycap layer to define a space; the haptic actuator is received in the space.

In an embodiment, the hardness of the circuit layer is larger than the hardness of the keycap layer, and the thickness of the circuit layer is smaller than the thickness of the keycap layer.

In an embodiment, the circuit layer is made from a polyethylene terephthalate (PET) film and a circuit is formed on the PET film; the keycap layer is made from a material selected from the group consisting of polyurethane (PU), thermalplastic polyurethane (TPU), leather, textile, and silicone.

In an embodiment, the thickness of the circuit layer is in a range of 0.05 mm to 0.5 mm. The thickness of the keycap layer is in a range of 0.1 mm to 2 mm.

In an embodiment, the supporting structure layer includes a cushion layer having a protrusion portion and a support layer having an opening corresponding to the keycap region. The protrusion portion is disposed around the accommodation space and protrudes into the opening.

In an embodiment, the keycap layer has a character or pattern formed on an upper surface of the keycap layer to define the keycap region.

In another embodiment, the invention provides an input device including a plurality of the keyswitch structures described above, wherein the plurality of the keycap regions of the keyswitch structures are connected by the peripheral regions to form an unitary keycap layer, and the adhesive layer is disposed on the peripheral regions outside the keycap regions.

DETAILED DESCRIPTION OF THE PREFERRED EMBODIMENT

The invention provides a keyswitch structure and an input device having the keyswitch structure. Particularly, the invention provides a keyswitch structure capable of reducing energy consumption of haptic feedback and an input device having the keyswitch structure. The input device of the invention can be any input device having the keyswitch structure, such as an independent keyboard device, an input device integrated into electronic devices, such as the key button or keyboard provided in portable devices or tablet computers, but not limited thereto. Hereafter, a computer keyboard is illustrated as an example to explain the details of the keyswitch structure and the input device of the invention.

Figure 1A:
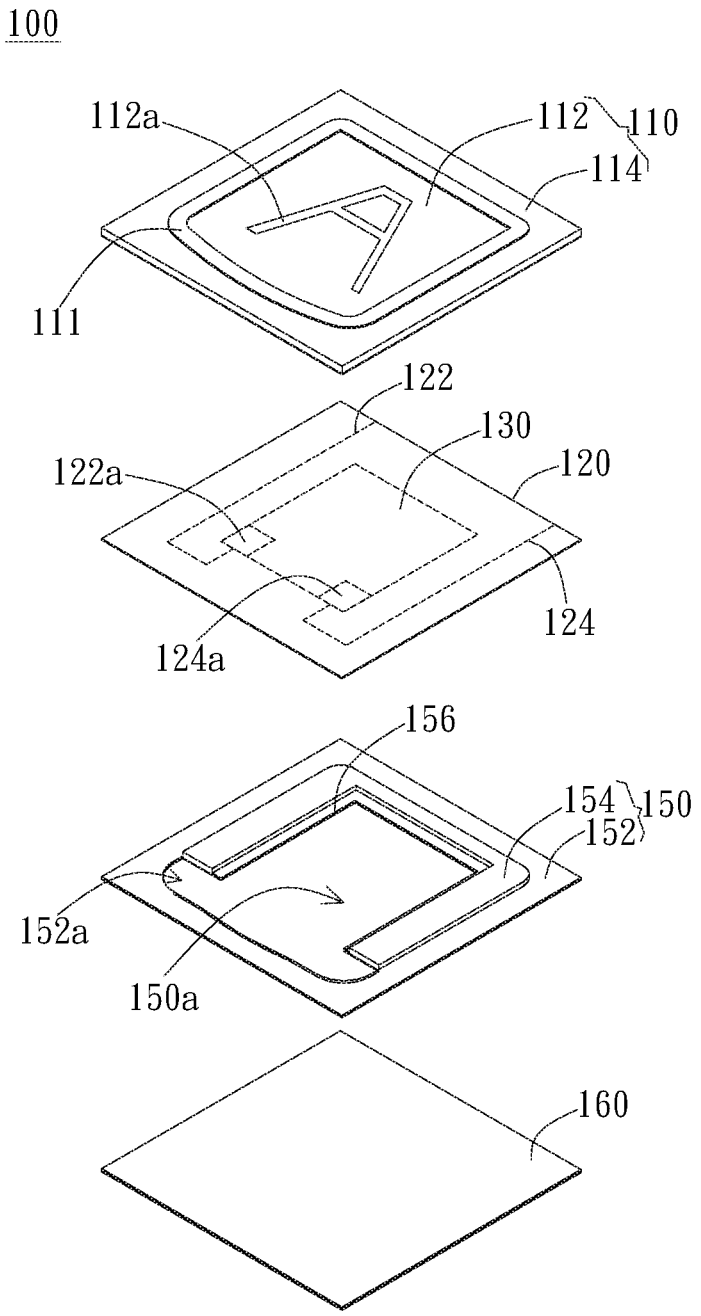
FIG. 1A is an exploded view of the keyswitch structure according to an embodiment of the invention.
Figure 1B:
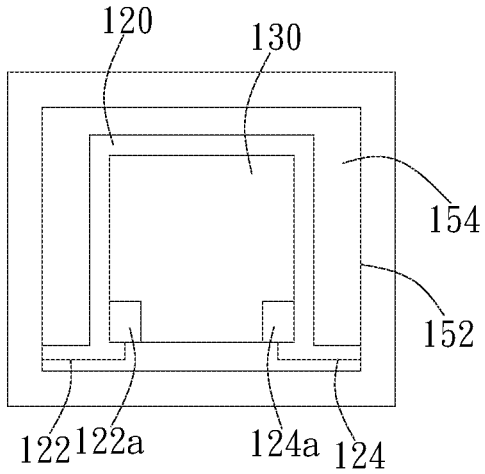
FIG. 1B is a schematic view showing the arrangement of the keyswitch structure including the circuit layer, the haptic actuator, and the cushion layer according to an embodiment of the invention.
Figure 1C:
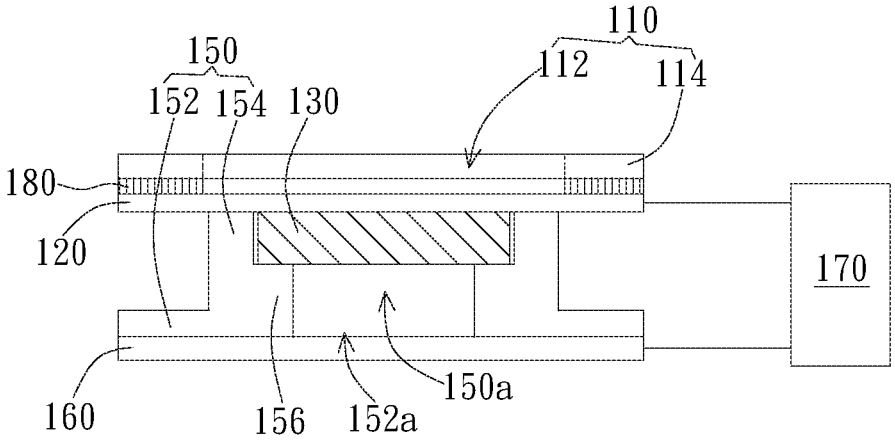
FIG. 1C is a cross-sectional view of FIG. 1A.

As shown in FIGS. 1A to 1C, in an embodiment, the keyswitch structure 100 is a multi-layered film structure and includes a keycap layer 110, a circuit layer 120, at least one haptic actuator 130, a cushion layer 150, and an adhesive layer 180 (see FIG. 1C). In this embodiment, the keycap layer 110 functions as an interface for user to operate or press the keyswitch structure 100. The circuit layer 120 is disposed under the keycap layer 110 and serves as a circuit path layer to transmit a driving signal D as well as a substrate layer to carry the haptic actuator 130. The haptic actuator 130 is disposed under the circuit layer 120 and electrically connected to the circuit layer 120 to serve as the haptic feedback layer after the user presses the keycap layer 110. The cushion layer 150 is disposed under the circuit layer 120 and serves as (a) a force-transferring layer to transfer an external force to a sensing unit 160 as well as (b) a supporting structure layer to support the circuit layer 120. The adhesive layer 180 is disposed between the keycap layer 110 and the circuit layer 120 and corresponds to only a peripheral region 114 of the keycap layer 110 to adhere the keycap layer 110 to the circuit layer 120.

The keyswitch structure 100 of the invention can further include components, such as a sensing unit 160, a control circuit 170 (see FIG. 1C). The sensing unit 160 is disposed under the cushion layer 150. The sensing unit 160 outputs a trigger signal T whenever the sensing unit 160 is triggered. The control circuit 170 couples the sensing unit 160 and the circuit layer 120 and can be disposed at any suitable position according to practical application needs. The control circuit 170 outputs a sensing signal and the driving signal D whenever the control circuit 170 receives the trigger signal T from the sensing unit 160. The circuit layer 120 is electrically connected to the haptic actuator 130 and provides the circuit paths for driving the haptic actuator 130, so that the control circuit 170 can electrically couple the haptic actuator 130 through the circuit layer 120. The cushion layer 150 transfers the external force. That is, when the external force is applied to the keycap layer 110, the external force is delivered downwardly through the cushion layer 150 to trigger the sensing unit 160. The sensing unit 160 is a membrane switch type sensing layer. When the sensing unit 160 is triggered, the sensing unit 160 outputs the trigger signal T and the control circuit 170 outputs (1) the sensing signal for inputting a character or command and (2) the driving signal D that drives the haptic actuator 130 to provide haptic feedback, such as vibration.

Moreover, the "haptic actuator" generally refers to any suitable component that can be driven by the driving signal D to provide haptic feedback, such as vibration. The haptic actuator includes, not limited to, piezoelectric actuator, voice coil actuator, pager motor, solenoid, or other type haptic actuators. The piezoelectric actuator is small in size and very thin, so the piezoelectric actuator is very suitable for use in the keyswitch having the multi-layered film structure. Hereinafter, the piezoelectric actuator is adopted for explaining the detailed structure and correlation of the elements of the keyswitch structure.

As shown in FIGS. 1A to 1C, the keycap layer 110 is disposed on the circuit layer 120 and has a keycap region 112 and a peripheral region 114, wherein the peripheral region 114 is adjacently connected to the periphery of the keycap region 112. The keycap region 112 corresponds to the haptic actuator 130 and serves as a pressing region for the user to press or operate the keyswitch structure, and the peripheral region 114 is physically attached to the underlying circuit layer 120. In this embodiment, the peripheral region 114 is disposed to surround the keycap region 112, and the keycap region 112 has a character or pattern 112*a* to indicate the command or character that will be inputted by the keyswitch structure. Moreover, an area-identifier 111 is provided on the keycap layer 110 to define the area of the keycap region 112, so that the user can easily identify the location of the keycap region 112 to promote the pressing accuracy. In other words, the area-identifier 111 is disposed on the boundary between the keycap region 112 and the peripheral region 114 to define the keycap region 112 and the peripheral region 114. In this embodiment, the area-identifier 111 can be a raised frame, wherein the inner region of the raised frame (or as well as the raised frame itself) is defined as the keycap region 112, and the outer region of the raised frame is defined as the peripheral region 114. During blind-typing, the user can identify the location of the keycap region 112 by means of the area-identifier 111 that protrudes from the periphery of the keycap region 112 to promote the typing speed and the typing accuracy. Moreover, the area-identifier 111 and the character or pattern 112*a* can be formed on the upper surface of the keycap layer 110 by printing, press-printing, adhering, laser-carving, etc. The area-identifier 111 and the character or pattern 112*a* may have different configurations, not limited to the embodiment.

The thickness of the keycap layer 110 is preferably in a range of 0.1-2 mm, and the keycap layer 110 is preferably made of flexible or soft material to increase the comfortability when the user presses the keyswitch structure 100. When the user presses the keycap region 112, the flexible or soft material has relatively lower hardness to improve the pressing comfortability, and the energy loss in the radial direction of the pressing point is relatively smaller. In addition, the keycap region 112 provides a better reflexibility in response to the haptic feedback due to the flexible or soft characteristics. When the reflexibility of the keycap region 112 is higher, the thickness of the keycap region 112 at the depressing point is smaller, and the path of transmitting energy to the user (e.g. finger) is shorter, so that the kinetic energy loss of the haptic actuator 130 occurring during vibration can be reduced. The keycap layer 110 can be made from a material selected from the group consisting of polyurethane (PU), thermalplastic polyurethane (TPU), leather, textile, and silicone.

In an embodiment, the keycap layer 110 can be disposed only over the circuit layer 120 to be the topmost layer of the keyswitch structure 100. In this case, the keyswitch structure 100 can optionally include a keyboard frame to integrate all components in the keyboard frame and expose the keycap layer 110 for user to operate. Moreover, the keyswitch structure 100 may optionally include a baseplate (not shown). The baseplate is disposed under the sensing unit 160 to increase the structural strength of the keyswitch structure 100. The baseplate is preferably made of a material having relatively higher rigidity, such as metal plate, hard plastics or polymers, to maintain the structural strength of the keyswitch structure 100 and prevent the keyswitch structure 100 from damage caused by overbending. The keyboard frame and the baseplate can be integrated into one piece, so that the bottom portion of the integrated frame can serve as the baseplate. In another embodiment, the keycap layer 110 can be a cover layer to encapsulate all components of the keyswitch structure 100, but not limited thereto.

The circuit layer 120 has a thin film or sheet-like configuration and is preferably made of a material having a relatively higher rigidity to serve as a substrate layer to carry the haptic actuator 130. The thickness of the circuit layer 120 is preferably in a range of 0.05-0.5 mm. The circuit layer 120 includes an insulation layer and conductive circuit paths (i.e. circuit) formed on the insulation layer. The insulation layer can be made of polyethylene terephthalate (PET), for example. That is, the hardness of the circuit layer 120 is harder than the hardness of the keycap layer 110, and the thickness of the circuit layer 120 is preferably smaller than the thickness of the keycap layer 110. As shown in FIGS. 1A and 1B, the circuit layer 120 is disposed under the keycap layer 110, and the circuit layer 120 has at least one first contact 122*a* and at least one second contact 124*a* on a bottom surface of the circuit layer 120 to electrically connect the haptic actuator 130. The first contact 122*a* is electrically isolated from the second contact 124*a*. Particularly, the circuit layer 120 has a first circuit path 122 and a second circuit path 124, and the first circuit path 122 and the second circuit path 124 construct a circuit loop, so that the driving signal D can be transmitted from the control circuit 170 to the haptic actuator 130. The first circuit path 122 and the second circuit path 124 are electrically isolated and disposed on the bottom surface of the circuit layer 120. The first circuit path 122 includes the first contact 122*a*, and the second circuit path 124 includes the second contact 124*a*. That is, the first circuit path 122 and the second circuit path 124 are disposed on one side of the circuit layer 120 (i.e. bottom side) opposite to the keycap layer 110, so that the haptic actuator 130 and the keycap layer 110 are disposed on two opposite sides of the circuit layer 120, respectively.

In this embodiment, the haptic actuator 130 includes piezoelectric materials and preferably in a sheet or film configuration. The piezoelectric materials can be piezoelectric single crystal, piezoelectric polycrystalline (piezoelectric ceramics), piezoelectric polymers, or piezoelectric composite materials, but not limited thereto. The haptic actuator 130 is disposed under the circuit layer 120 and electrically connected to the first contact 122*a* of the first circuit path 122 and the second contact 124*a* of the second circuit path 124, so that the driving signal D can be transmitted from the control circuit 170 to the haptic actuator 130 through the circuit paths 122, 124 to drive the haptic actuator 130 to provide the haptic feedback, such as vibration feedback. It is noted that the haptic actuator 130 is preferably physically connected to the circuit layer 120 by means of the connection to the first contact 122*a* and the second contact 124*a* and keeps separated from or non-adhered to other portions of the circuit layer 120, so that the haptic actuator 130 can provide a larger vibration effect. For example, the haptic actuator 130 can be electrically connected to the first contact 122*a* and the second contact 124*a* by silver glue, solder, or any suitable electrical connection materials to physically attach to the circuit layer 120, so that most portions of the haptic actuator 130 remain unattached or non-adhered to the circuit layer 120 to provide a greater vibration effect. However, in another embodiment, as the haptic actuator 130 itself is capable of providing sufficient vibration, in addition to the first contact 122*a* and the second contact 124*a*, the haptic actuator 130 can be physically attached to other portions of the circuit layer 120 to enhance the adhesion of the haptic actuator 130 to the circuit layer 120 and prevent the detachment of the haptic actuator 130 from the circuit layer 120. Moreover, with respect to the circuit layer 120, the vibration direction of the haptic actuator 130 can include up/down butterfly type vibration or horizontal contraction, and the vibration manner can include continuous vibration or pulse vibration, but not limited thereto.

As shown in FIGS. 1A to 1C, the cushion layer 150 is disposed under the circuit layer 120. The cushion layer 150 has an accommodation space 150*a* for accommodating the haptic actuator 130. Particularly, the cushion layer 150 includes a film portion 152 and a protrusion portion 154. The film portion 152 has an accommodation area 152*a*, and the protrusion portion 154 is disposed around the accommodation area 152*a* and extends from the film portion 152 toward the circuit layer 120 to define the accommodation space 150*a* over the accommodation area 152*a*, so that the haptic actuator 130 can be accommodated and vibrate in the accommodation space 150*a*. In this embodiment, the film portion 152 has a through hole as the accommodation area 152*a*. In other words, the protrusion portion 154 is disposed around the through hole 152*a* and extends beyond the upper surface of the film portion 152 toward the circuit layer 120 to define the accommodation space 150*a* over the accommodation area 152*a* (i.e. the through hole). As such, the top surface of the protrusion portion 154 is higher than the top surface of the film portion 152, and the through hole 152*a* communicates with the accommodation space 150*a*. It is noted that the accommodation area 152*a* of the film portion 152 can have other configurations and not limited to the through hole. In another embodiment, the accommodation area 152*a* of the film portion 152 can be a portion of the surface region of the film portion 152 or a recessed region of the film portion 152. Moreover, the accommodation area 152*a* is preferably disposed at a location corresponding to the keycap region 112. According to the design needs, the accommodation area 152*a* can have any suitable shapes other than the rectangular shape shown in FIG. 1A. In other embodiments (not shown), the accommodation area 152*a* can have a circular shape, an oval shape, or any suitable shapes. Corresponding to the shape of the accommodation area 152*a*, the protrusion portion 154 can be disposed to surround a portion of the periphery of the accommodation area 152*a* or substantially the entire periphery of the accommodation area 152*a*. In this embodiment, the protrusion portion 154 is a continuous protrusion structure, but not limited thereto. In another embodiment, the protrusion portion 154 can be a non-continuous structure. That is, the protrusion portion 154 can include a plurality of raised blocks or pillars disposed around the accommodation area 152*a*. As the cushion layer 150 serves as the supporting structure layer of the circuit layer 120, the thickness of the protrusion portion 154 is preferably larger than the thickness of the haptic actuator 130. When the haptic actuator 130 vibrates within the accommodation space 150*a*, the thickness of the protrusion portion 154 is sufficient to provide appropriate vibration space for the haptic actuator 130. That is, there is enough space provided under the haptic actuator 130 to achieve the haptic feedback.

In an embodiment, the cushion layer 150 further has an extension portion 156 extending from the protrusion portion 154 toward the inner side of the accommodation space 150*a*. The extension portion 156 has a top surface lower than the top surface of the protrusion portion 154. As shown in FIG. 1C, as the haptic actuator 130 is accommodated in the accommodation space 150*a*, the haptic actuator 130 preferably at least partially abuts on the top surface of the extension portion 156. In other words, the top surface of the extension portion 156 is preferably higher than the top surface of the film portion 152 and lower than the bottom surface of the haptic actuator 130, and the extension portion 156 preferably extends toward the inner side of the accommodation space 150*a* to be partially disposed under the bottom surface of the haptic actuator 130. As such, the protrusion portion 154 extends upward from the film portion 152 can provide the vibration space (e.g. 150*a*) under the keycap layer 110 for the haptic actuator 130, and the extension portion 156 provides underlying support during vibration of the haptic actuator 130 to prevent the haptic actuator 130 from pressing against the sensing unit 160.

The cushion layer 150 is preferably made of cushion materials having hardness equal to or lower than 70A, and more preferably 10A-60A by the laser or hot-press molding technique. In an embodiment, the cushion layer 150 is made of silicone materials. In other words, the cushion layer 150 is preferably made of soft materials to prevent the sensing unit 160 from inadvertently generating a false trigger signal caused by the weight of the cushion layer 150 when the keycap layer 110 is not pressed. As described above, the cushion layer 150 transfers the force to the underlying sensing unit 160 and triggers the sensing unit 160 to output the trigger signal T. In this embodiment, the force can be transferred through two paths to the sensing unit 160, for example, (1) through the circuit layer 120 and the protrusion portion 154, (2) through the circuit layer 120, the haptic actuator 130, and the extension portion 156.

As shown in FIG. 1C, the adhesive layer 180 is disposed on a bottom surface of the keycap layer 110 outside the keycap region 112, so that only a portion of the keycap layer 110 corresponding to the peripheral region 114 is adhered to the circuit layer 120 by the adhesive layer 180. Particularly, the adhesive layer 180 is disposed on a portion of the bottom surface of the keycap layer 110 that corresponds only to the peripheral region 114. In other words, no adhesive layer 180 is disposed on the bottom surface of the keycap layer 110 that corresponds to the keycap region 112, so that the bottom surface of the keycap region 112 is not adhered to the circuit layer 120 or is separated from the circuit layer 120 by a gap. As such, when the haptic actuator 130 is driven by the driving signal D to vibrate, the haptic actuator 130 need not to vibrate with the keycap region 112 of the keycap layer 110, so that the kinetic energy loss of the haptic actuator 130 occurring during vibration can be reduced. That is, if the entire keycap layer 110 is adhered to the circuit layer 120, the "load" of the haptic actuator 130 is increased and the vibration of the haptic actuator 130 becomes more difficult, resulting in the increase in kinetic energy loss. In this embodiment, the thickness of the adhesive layer 180 is preferably less than 0.5 mm, but not limited thereto. Moreover, the remaining components of the keyswitch structure 100, such as the circuit layer 120, the cushion layer 150, and the sensing unit 160 can be connected by adhesives to fix the relative positions among the components.

Figure 1D:
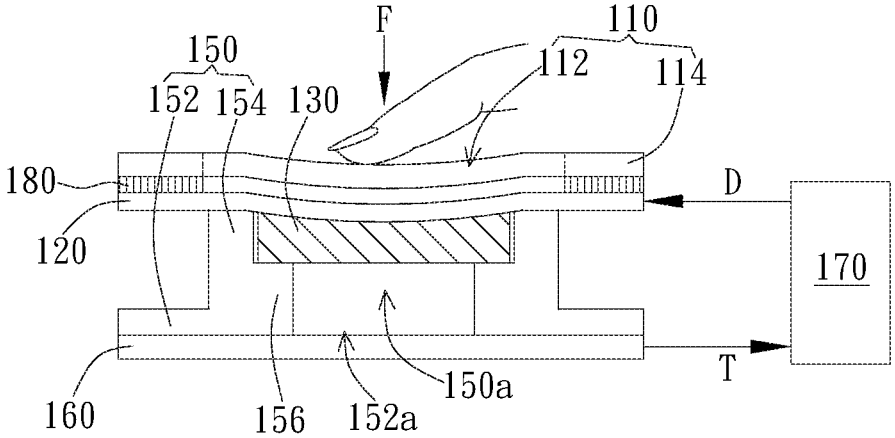
FIG. 1D is a schematic view showing the operation of FIG. 1A.

As shown in FIG. 1D, when an external force F is applied, the force F is delivered downwardly through the cushion layer 150 to trigger the sensing unit 160, so that the sensing unit 160 outputs the trigger signal T to the control circuit 170. Upon receiving the trigger signal T, the control circuit 170 outputs the driving signal D to drive the haptic actuator 130, so that the haptic actuator 130 can provide the haptic feedback, such as vibrations. That is, when the user presses the keyswitch structure 100 on the keycap region 112 of the keycap layer 110, by means of the structural characteristics of the cushion layer 150, such as the protrusion portion 154 and/or the extension portion 156, the pressing force can be transferred downwardly through at least one of the two paths as described above, so that the sensing unit 160 is triggered to output the trigger signal T. The trigger signal T not only serves as a sensing signal for inputting the corresponding character or command of the keyswitch structure 100, but also as an indicating signal for generating the driving signal D, so that the control circuit 170 can output the driving signal D upon receiving the trigger signal T. When the haptic actuator 130 receives the driving signal D from the control circuit layer 170 through the circuit paths of the circuit layer 120, such as the first circuit path 122 and the second circuit path 124, the haptic actuator 130 vibrates within the accommodation space 150*a* to provide the vibration feedback of confirming the key-pressing operation.

Moreover, in the above embodiment, the cushion layer 150 functions as the supporting structure layer and the force-transferring layer of the keyswitch structure 100; however, in other embodiments, the keyswitch structure may have additional structure layer as the supporting structure layer. As shown in FIGS. 2A to 2D, the keyswitch structure 100' further includes a support layer 140 to support the circuit layer 120. The support layer 140 is disposed between the circuit layer 120 and the cushion layer 150 and can be the major support structure for the keyswitch structure 100' to ensure sufficient vibration space for the haptic actuator 130. The support layer 140 is disposed on the film portion 152 and has an opening 140*a*. The protrusion portion 154 protrudes into the opening 140*a* toward the circuit layer 120. That is, the opening 140*a* preferably corresponds to the keycap region 112 of the keycap layer 110 and the area of the opening 140*a* covers the protrusion portion 154 that surrounds the accommodation area 152*a*. As such, when the support layer 140 is disposed on the film portion 152, the protrusion portion 154 is inserted into the opening 140*a*, as shown in FIG. 2C. The hardness of the support layer 140 is preferably higher than the hardness of the cushion layer 150, and the thickness of the support layer 140 is larger than the thickness of the haptic actuator 130, so that the circuit layer 120 and the sensing unit 160 maintain a predetermined distance separated from each other to provide the vibration space for the haptic actuator 130. In other words, when the user exerts larger force on the keycap layer 110, the support layer 140 can ensure the haptic actuator 130 with sufficient vibration space, so that the haptic actuator 130 is likely not to press against the sensing unit 160, and the vibration of the haptic actuator 130 will not be impaired due to the compressed accommodation space 150*a* caused by the excessive deformation of the cushion layer 150, which has insufficient hardness. Consequently, the decrease of haptic feedback provided by the haptic actuator 130 can be prevented. Alternatively, in the embodiment of FIG. 1A, if the cushion layer 150 is able to sustain the pressing force without excessive deformation and the accommodation space 150*a* is not overly compressed, the support layer 140 is an optional layer.

The thickness of the support layer 140 depends on the thickness of the haptic actuator 130 and the height of the vibration space. For example, when the height of the vibration space is equal to or larger than 0.8 mm, the haptic actuator 130 will have a better vibration effect. Therefore, the thickness of the support layer 140 is preferably designed to be larger than the thickness of the haptic actuator 130 and able to maintain a vibration space having a height of 0.8 mm or larger under the haptic actuator 130 when pressing the keycap layer 110. In an embodiment, the opening 140*a* of the support layer 140 preferably corresponds to the keycap region 112. In other words, the shape, size and location of the opening 140*a* preferably correspond to those of the keycap region 112, so that when the user presses the keycap region 112, the pressing force can be delivered to the sensing unit 160 through the force-transferring portion of the cushion layer 150, such as the protrusion portion 154 and/or the extension portion 156. Moreover, the sensing circuit of the sensing unit 160 is preferably disposed right under the force-transferring portion of cushion layer 150, so that the pressing force exerted on the keycap region 112 can be transferred through the above two paths to trigger the sensing unit 160 normally, and the possibility of miss-triggering the sensing unit 160 by exerting force on the non-keycap region through the support layer 140 can be reduced.

Figure 2A:
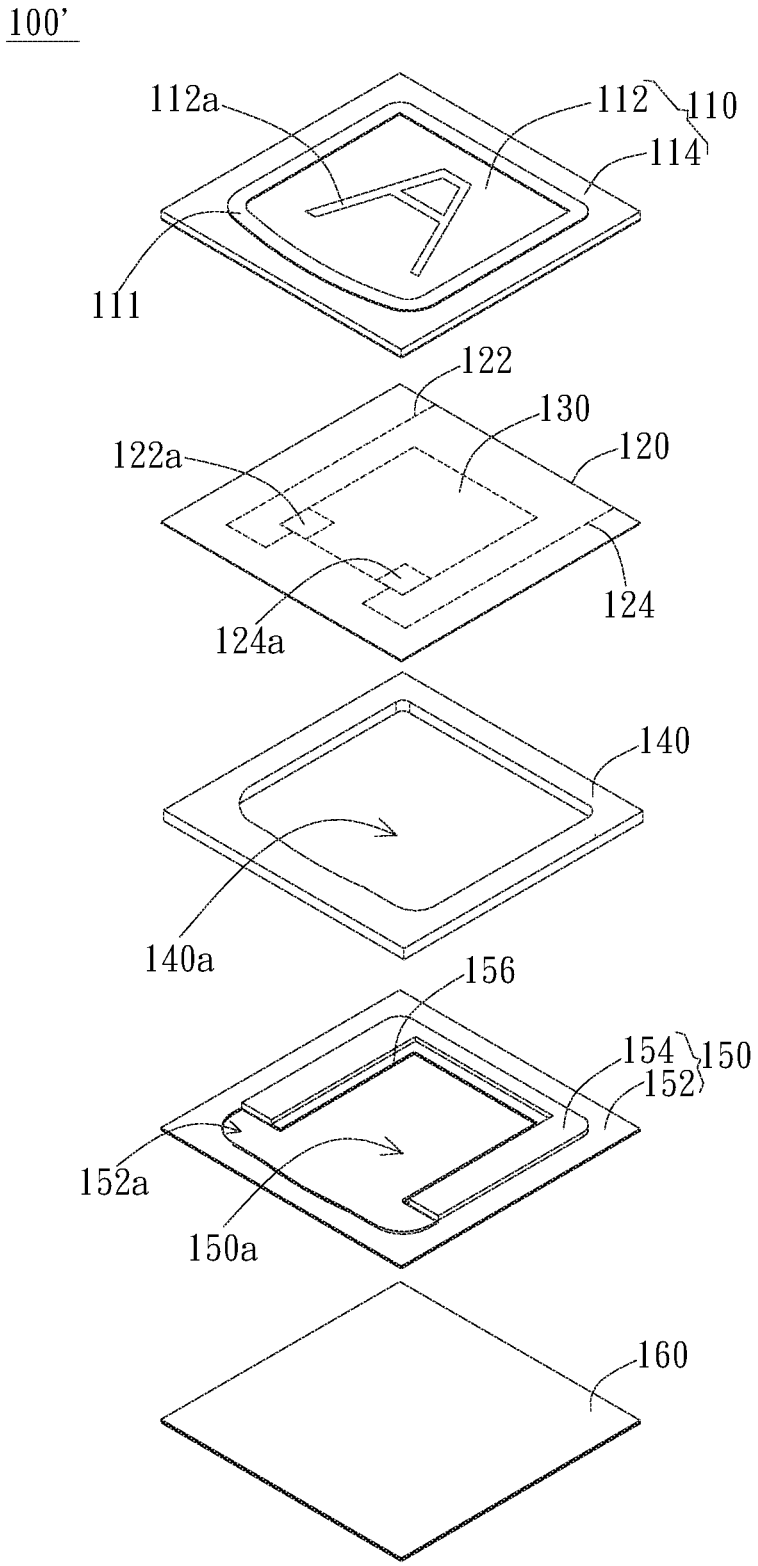
FIG. 2A is an exploded view of the keyswitch structure according to another embodiment of the invention.
Figure 2B:
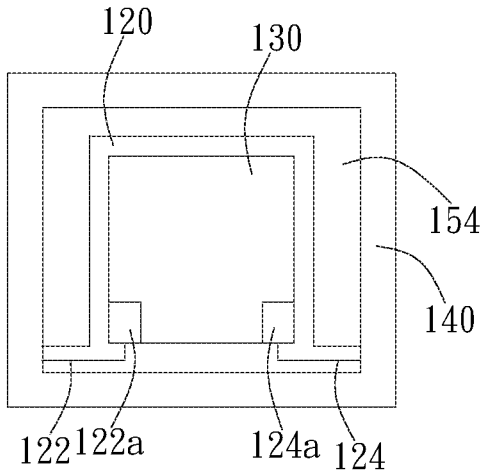
FIG. 2B is a schematic view showing the arrangement of the keyswitch structure including the circuit layer, the haptic actuator, the support layer and the cushion layer according to another embodiment of the invention.
Figure 2C:
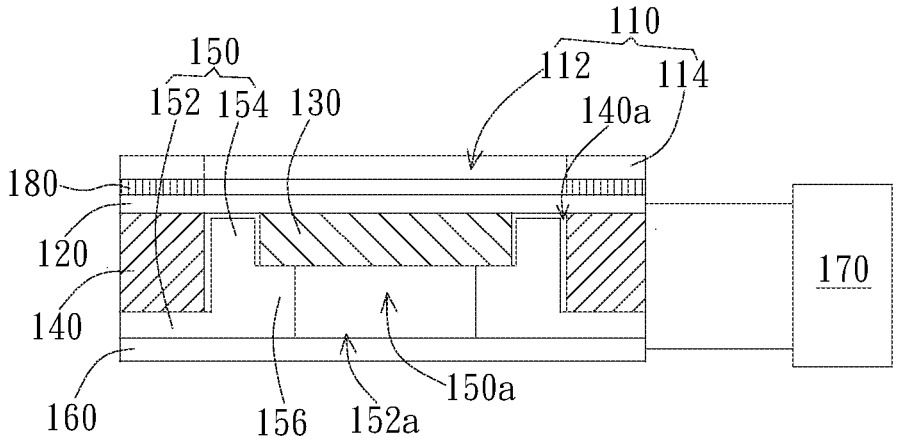
FIG. 2C is a cross-sectional view of FIG. 2A.
Figure 2D:
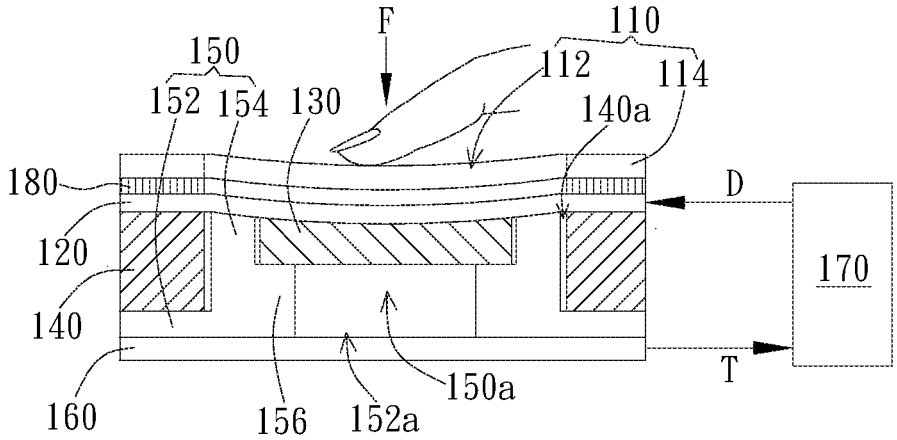
FIG. 2D is a schematic view showing the operation of FIG. 2A.

As shown in FIG. 2D, when an external force F is applied to the keycap region 112, the force F is delivered downwardly through the cushion layer 150 to trigger the sensing unit 160, and then the sensing unit 160 outputs the trigger signal T to the control circuit 170. Upon receiving the triggering signal T, the control circuit 170 outputs the driving signal D to the haptic actuator 130 to drive the haptic actuator 130. In other words, when the user presses the keyswitch structure 100 on the keycap region 112 of the keycap layer 110, under the pressing force, the support layer 140 still provides sufficient vibration space for the haptic actuator 130, and the pressing force is downwardly transferred through at least one of the above two paths by the protrusion portion 154 and/or the extension portion 156 of the cushion layer 150 to trigger the sensing unit 160 to output the trigger signal T. The trigger signal T not only serves as a sensing signal for inputting the corresponding character or command of the keyswitch structure 100', but also as an indicating signal for generating the driving signal D, so that the control circuit 170 can output the driving signal D upon receiving the trigger signal T. When the haptic actuator 130 receives the driving signal D from the circuit layer 120 through the circuit paths of the circuit layer 120, such as the first circuit path 122 and the second circuit path 124, the haptic actuator 130 vibrates within the accommodation space 150*a* to provide the vibration feedback for the user to confirm the key-pressing operation.

It is noted that in the embodiments of FIGS. 1D and 2D, since the circuit layer 120 carrying the haptic actuator 130 is merely adhered to the peripheral region 114 of the keycap layer 110, the keycap region 112 is not directly linked to the haptic actuator 130 as the haptic actuator 130 vibrates (i.e. the keycap region 112 is not physically adhered to the circuit layer 120 or is separated from the circuit layer 120), the vibration loading of the haptic actuator 130 is smaller so as to reduce the kinetic energy loss occurring during vibration. Furthermore, since the keycap layer 110 is less likely to vibrate with the haptic actuator 130, the external appearance of keycap layer 110 during vibration can be improved.

In the embodiments of FIGS. 1A and 2A, the keycap layer 110 can be made of a single material or multiple materials. For example, in an embodiment, the keycap layer 110 is preferably made from one of polyurethane (PU), thermal-plastic polyurethane (TPU), leather, textile, and silicone. For example, the keycap layer 110 can be a PU layer with a thickness of 0.5 mm to achieve a better external appearance. In another embodiment, the keycap layer 110 can be a silicone layer with a thickness of 1.5 mm to achieve a better operation effect. Moreover, the keycap layer 110 can be a multi-layered structure. That is, the keycap layer 110 may include a bottom keycap layer and a top keycap layer disposed on the bottom keycap layer. The top keycap layer may have a thinner thickness and be made of a harder material to protect the lower keycap layer, which is made from the above materials and relatively softer, to improve the external appearance. For example, in an embodiment, the bottom keycap layer can be a PU layer with a thickness of 0.1-2 mm, and the top keycap layer is a PET layer with a thickness of 0.075-0.25 mm, but not limited thereto.

Moreover, in the embodiments of FIGS. 1A and 2A, the top and bottom surfaces of the keycap layer 110 are both flat surfaces, i.e. the thickness of the keycap region 112 is substantially equal to the thickness of the peripheral region 114. However, in other embodiments, the keycap layer may have different configurations to enhance the vibration effect, the external appearance, the operation convenience or reduce the cost.

Figure 3A:
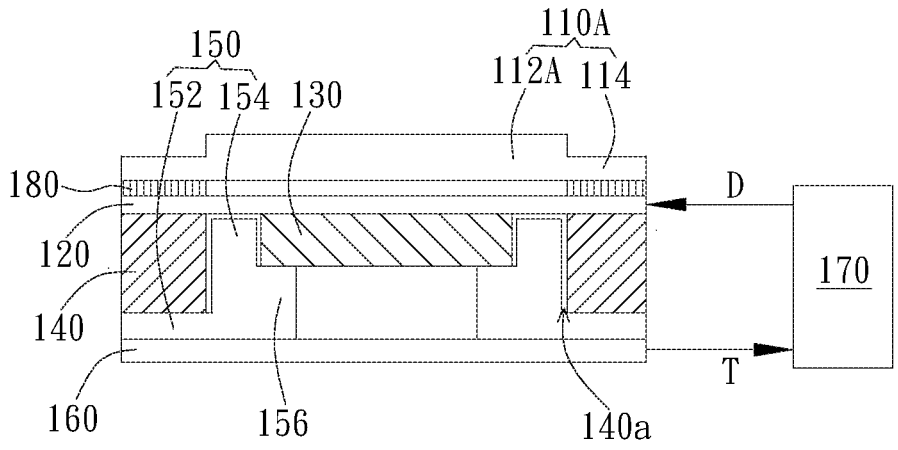
FIGS. 3A to 3D are schematic views of the keyswitch structure according to different embodiments of the invention.

For example, in the embodiment of FIG. 3A, the keycap layer 110A has a raised profile, wherein the thickness of the keycap layer 110A at the keycap region 112A is larger than the thickness of the keycap layer 110A at the peripheral region 114, so that the keycap region 112A protrudes beyond the peripheral region 114. In this embodiment, the keycap layer 110A can be made from PU, TPU, leather, textile, or silicone as described above. With such a configuration, the keycap layer 110A can be disposed with or without the area-identifier 111, since the raised keycap region 112A helps the user to effectively identify the area of the keycap region 112A during blind-typing and increase the typing speed and accuracy. According to experiment results, the raised keycap region 112A of FIG. 3A has a better vibration effect than the flat keycap region 112 of FIG. 1A due to less vibration dispersion paths.

Figure 3B:
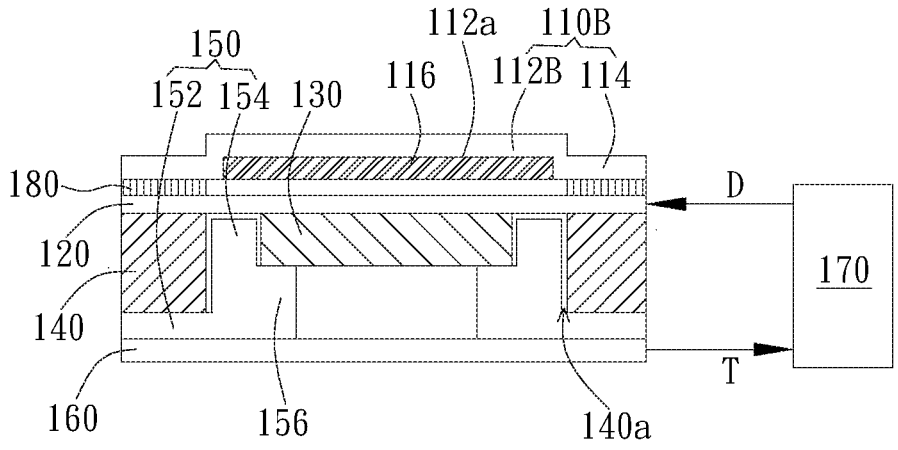
Figure 3C:
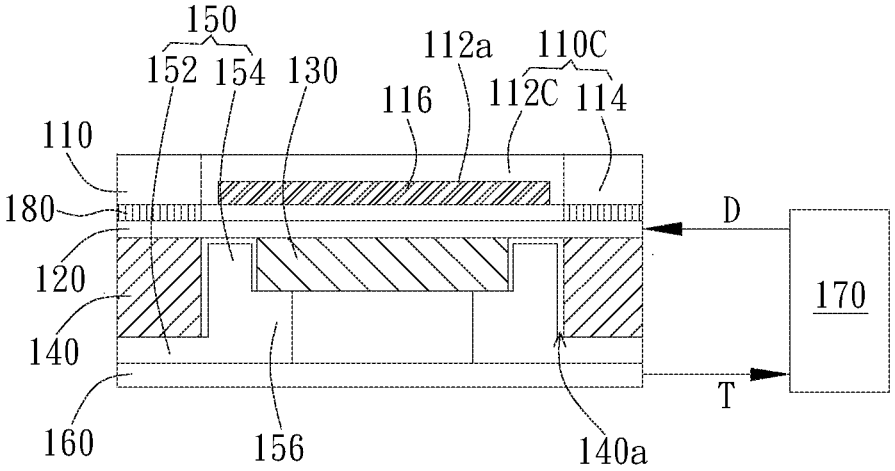

In the embodiments of FIGS. 3B and 3C, the keycap layer is made of multiple materials. As shown in FIGS. 3B and 3C, the keycap layer 110B, 110C has a recessed groove 112*a* formed on a lower surface of the keycap layer 110B, 110C corresponding to the keycap region 112B, 112C. A filling material 116 different from the material of the keycap layer 110B, 110C fills in the recessed groove 112*a*. For example, the keycap layer 110B, 110C can be made of PU material to promote the external appearance of the keycap layer, and the filling material 116 can be silicone to provide a better pressing effect.

Figure 3D:
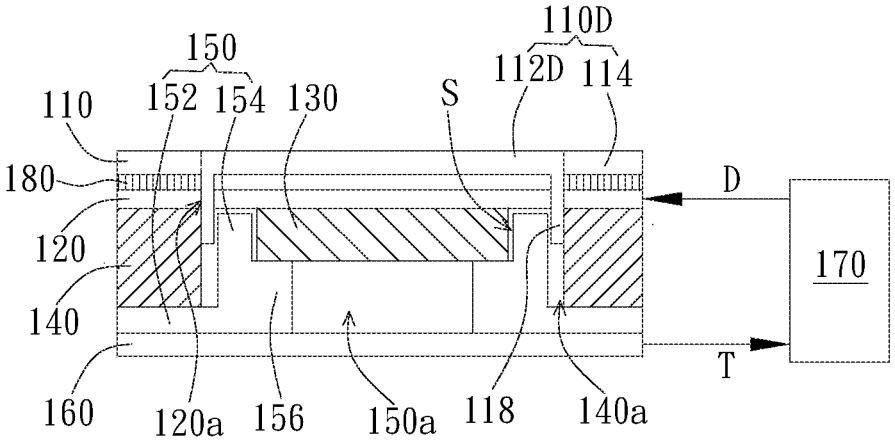

In the embodiment of FIG. 3D, the keycap layer 110D has a positioning portion 118 formed on a lower surface of the keycap layer 110D corresponding to the keycap region 112D. The circuit layer 120 has a positioning hole 120*a* corresponding to the positioning portion 118. The positioning portion 118 protrudes from the lower surface of the keycap layer 110D downwardly to be positioned in the positioning hole 120*a*. For example, the positioning portion 118 can be a stud protruding from the lower surface of the keycap layer 110D to define a space S with the lower surface of the keycap layer 110D. The haptic actuator 130 is received in the space S. In other words, the space S corresponds to the accommodation space 150*a*. As the positioning portion 118 is positioned in the positioning hole 120*a*, the positioning portion 118 is preferably located outside the protrusion portion 154 or between the support layer 140 and the protrusion portion 154, so that the portion of the circuit layer 120 that corresponds to the keycap region 112D is located within the space S, and the upper portion of the haptic actuator 130 is located within the space S while the lower portion of the haptic actuator 130 is located within the accommodation space 150*a*.

Figure 4A:
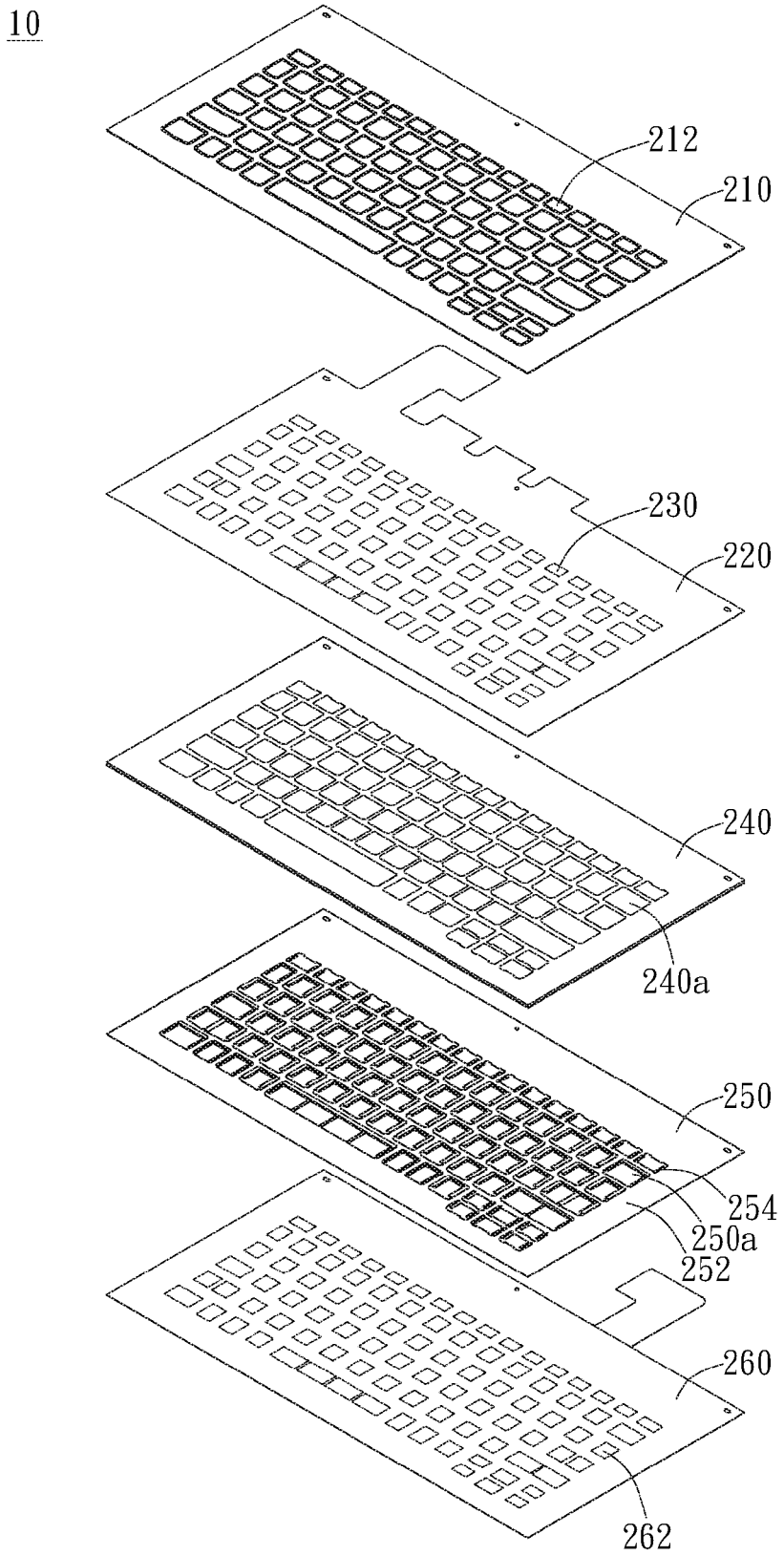
FIGS. 4A and 4B are an exploded view and an assembled view of the input device according to an embodiment of the invention, respectively.
Figure 4B:
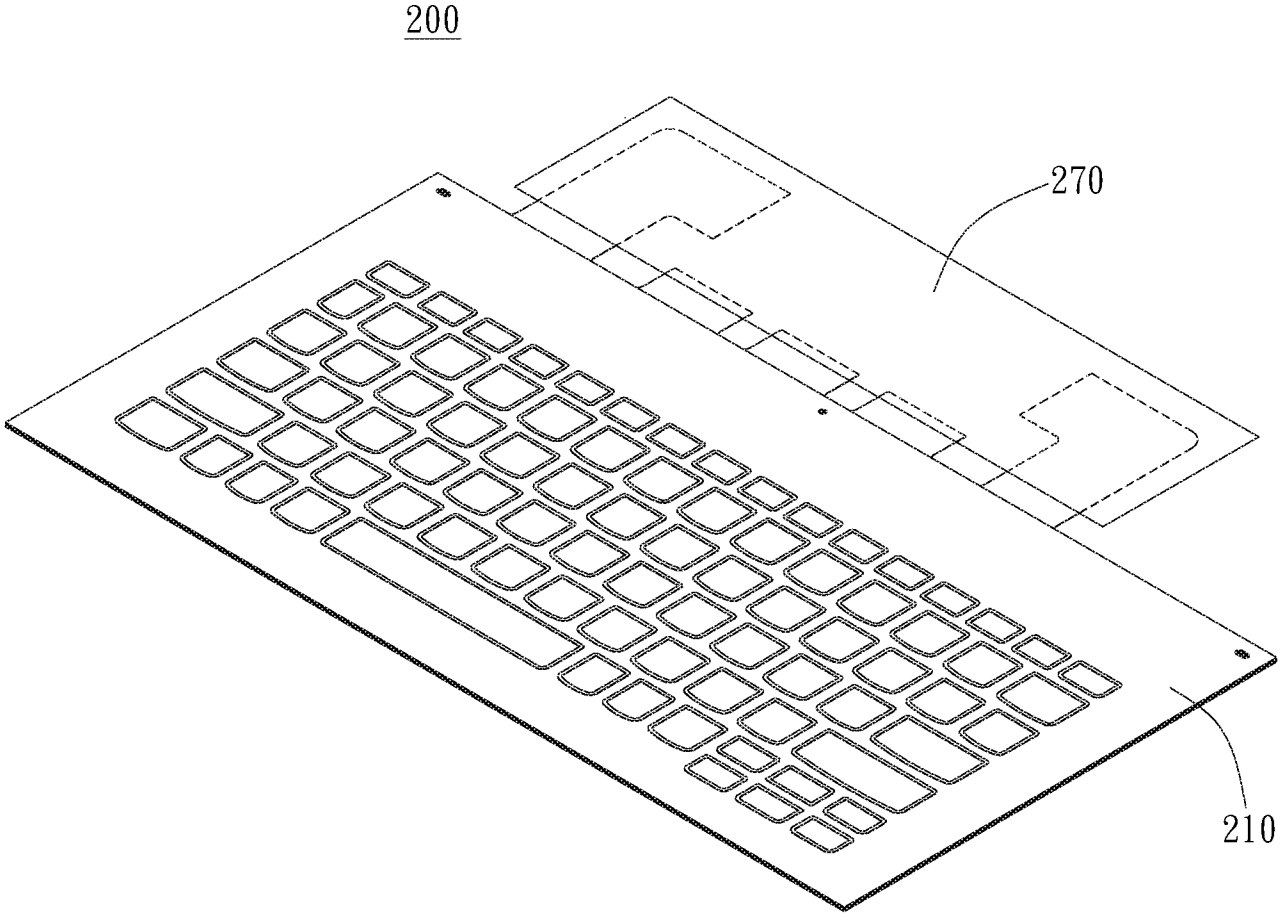

As shown in FIGS. 4A and 4B, in another embodiment, an input device 10 includes multiple keyswitch structures of the previous embodiments is provided. It is noted, in this embodiment, the input device 10 is illustrated as a computer keyboard device, but in other embodiments, the input device can include one or more keyswitch structures which can be arranged in any suitable manner. Moreover, in this embodiment, the input device 10 is illustrated to include the keyswitch structure of FIG. 2A, but not limited thereto. The input device of the invention can include one or more keyswitch structures selected from the keyswitch structures of the above embodiments or the combination thereof.

Figure 5B:
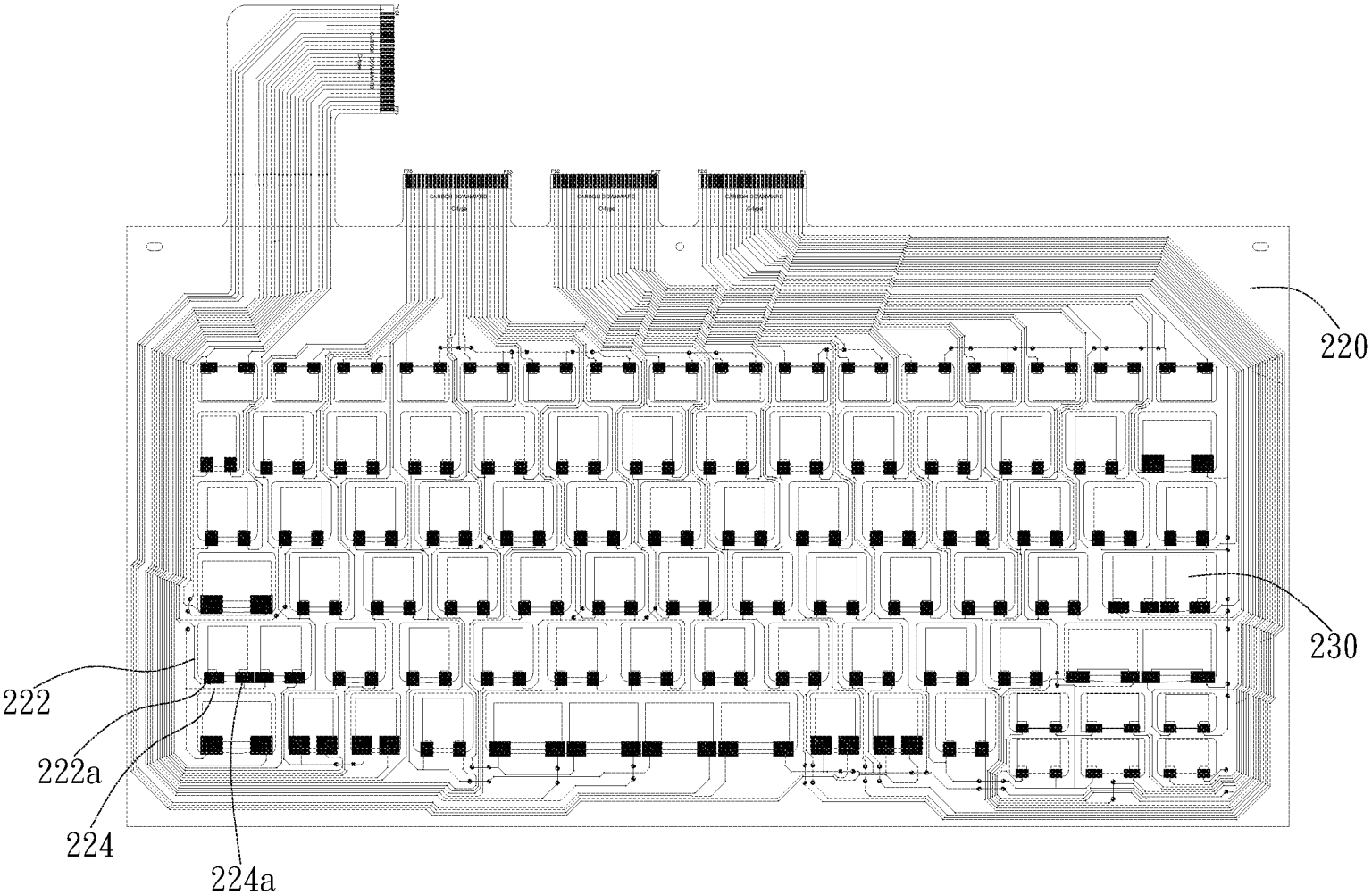
FIG. 5B is a schematic view of the circuit layer of FIG. 4A.
Figure 6:
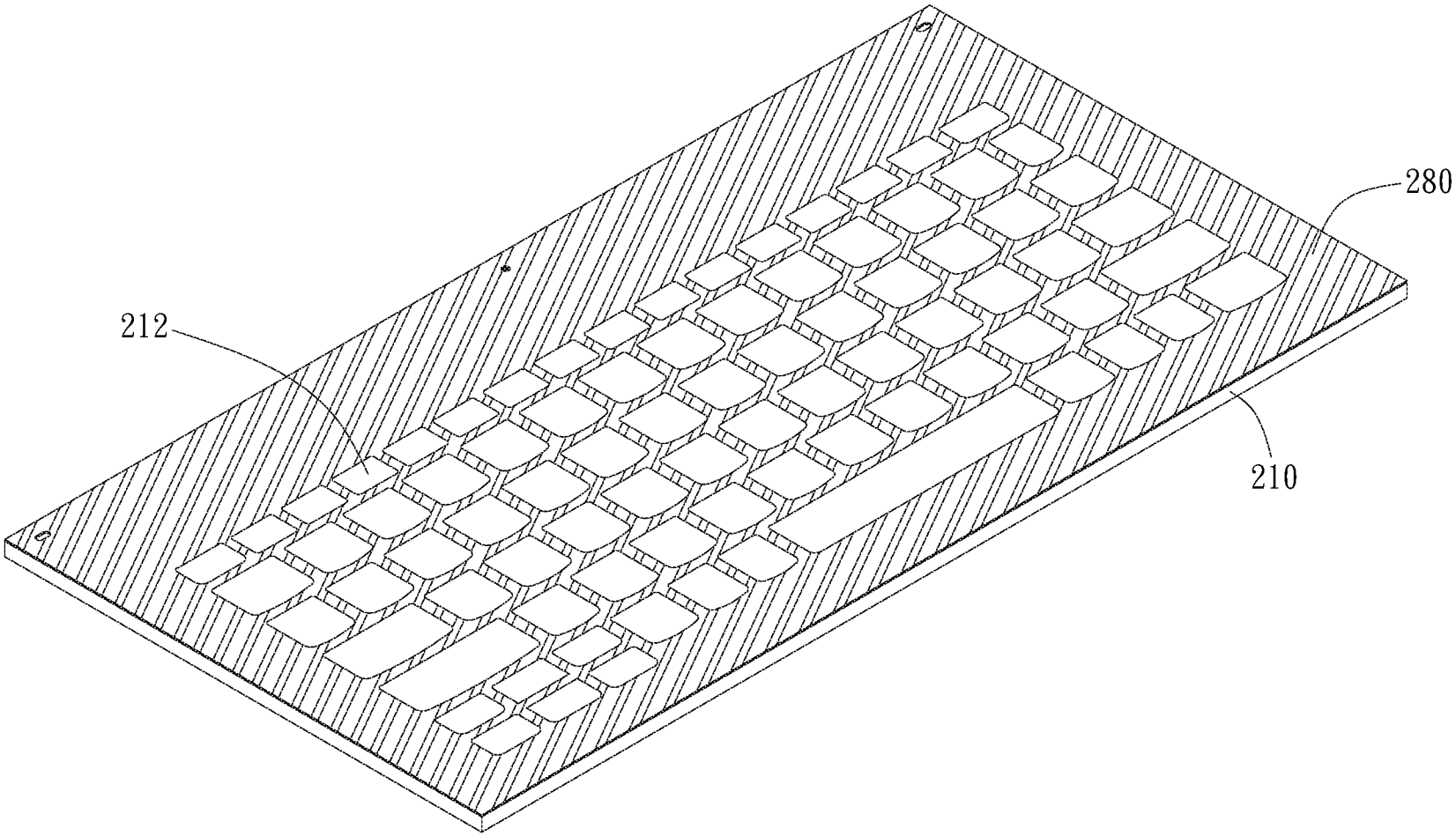
FIG. 6 is a schematic view showing the arrangement of the keycap layer and the adhesive layer of the input device according to an embodiment of the invention.

As shown in FIG. 4A, the input device 10 includes a keycap layer 210, a circuit layer 220, a plurality of haptic actuators 230, a support layer 240, a cushion layer 250, a sensor layer 260, a control circuit 270 (shown in FIG. 4B), and an adhesive layer 280 (shown in FIG. 6). In this embodiment, the keycap layer 210 has a plurality of keycap regions 212. The circuit layer 220 is disposed under the keycap layer 210. As shown in FIG. 5B, the circuit layer 220 has a plurality of first contacts 222*a* and a plurality of second contacts 224*a* on a bottom surface of the circuit layer 220. The first contacts 222*a* are electrically isolated from the second contacts 224*a*, and each of the keycap regions 212 is corresponding to at least one of the first contacts 222*a* and at least one of the second contacts 224*a*. The cushion layer 250 is disposed under the circuit layer 220. The cushion layer 250 has a plurality of accommodation spaces 250*a*. Each of the plurality of keycap regions 212 is corresponding to at least one of the accommodation spaces 250*a*, and each of the accommodation spaces 250*a* accommodates at least one of the plurality of haptic actuators 230. The sensor layer 260 is disposed under the cushion layer 250. The sensor layer 260 includes a plurality of sensing units 262. Each of the plurality of keycap regions 212 corresponds to at least one of the sensing units 262, and each of the sensing units 262 is capable of being triggered to output a trigger signal T. In other words, when multiple keyswitch structures are integrated into the input device 10, such as a computer keyboard, the corresponding components of the keyswitch structures can be integrated into a single component layer.

Figure 5A:
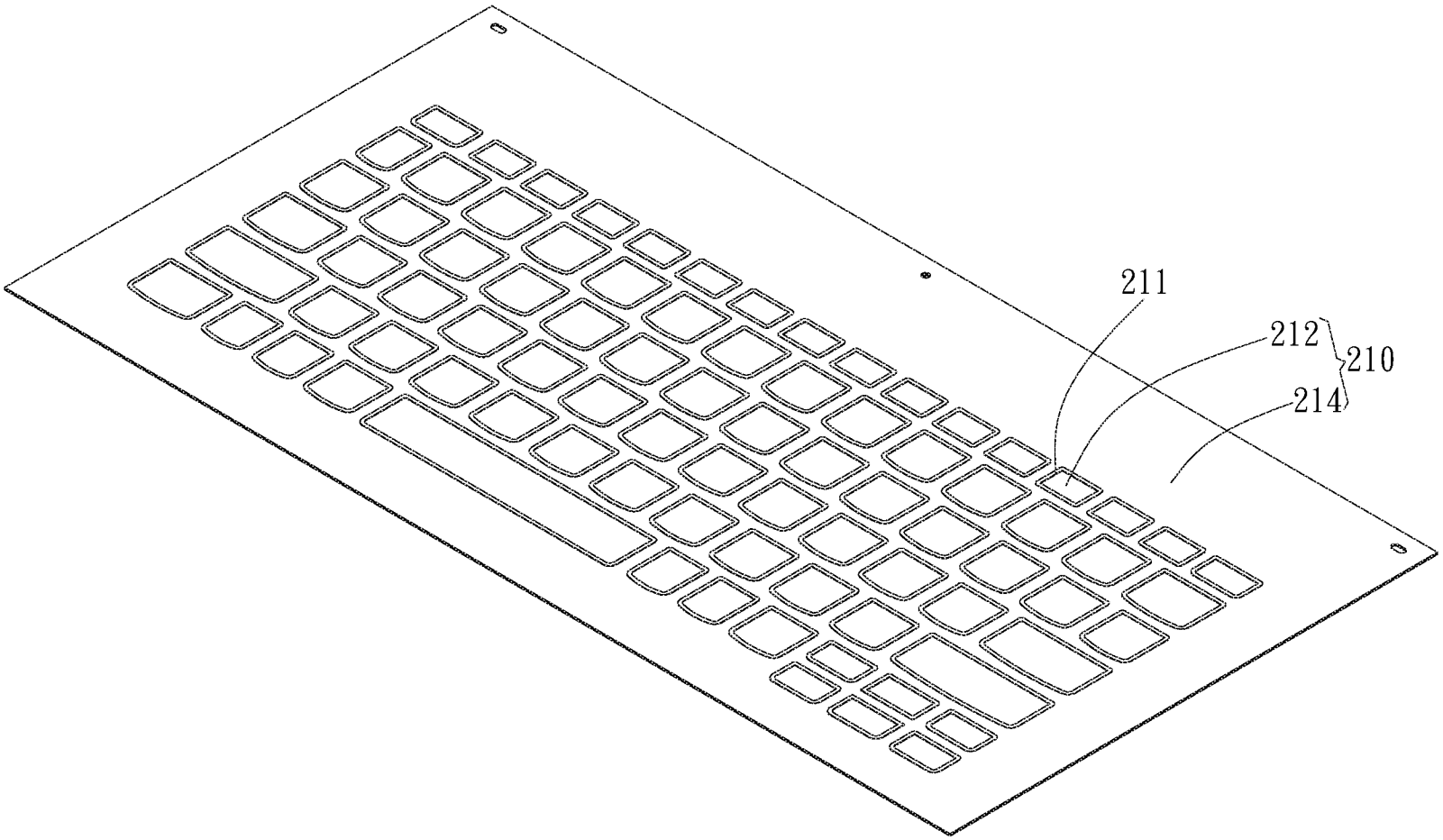
FIG. 5A is a schematic view of the keycap layer of FIG. 4A.

For example, as shown in FIGS. 4A and 5A, multiple keycap regions 212 can be connected by the peripheral region 214 to form a single keycap layer 210. Particularly, the keycap layer 210 can have a plurality of area-identifiers 211 to define the area of each keycap region 212, and the portion of the keycap layer 210 abutting the keycap regions 212 is the peripheral region 214. Similarly, each keycap region 212 has a corresponding character or pattern to indicate the command or character to be inputted by each keyswitch structure. In this embodiment, the keycap layer 210 can have similar properties as the keycap layer 110, 110A-110D, such as configuration, material or thickness and will not be elaborated again.

As shown in FIGS. 4A and 5B, the circuit layer 220 is disposed under the keycap layer 210. At least one of the first contacts 222*a* and at least one of the second contacts 224*a* correspond to each of the keycap regions 212 to electrically connect the haptic actuator 230. In other words, the plurality of haptic actuators 230 are disposed under the circuit layer 220. Each of the keycap regions 212 is corresponding to at least one of the haptic actuators 230, and each of the plurality of haptic actuators 230 is electrically connected to one of the first contacts 222*a* and one of the second contacts 224*a* corresponding to the same keycap region 212. It is noted that the haptic actuator 230 is similar to the haptic actuator 130, and the connection of the haptic actuator 230 to the circuit layer 220 can be referred to the related description of FIG. 1A. The circuit layer 220 includes a plurality of first circuit paths 222 and a plurality of second circuit paths 224 to provide the circuit paths to drive the haptic actuators 230, respectively. In this embodiment, the first circuit path 222 is a driving path and the second circuit path 224 is a ground path for driving the haptic actuator 230. The ground paths (i.e. the second circuit paths 224) for the plurality of haptic actuators 230 are preferably divided into groups and connected together, so that a single second circuit path 224 may have more than one second contact 224*a* and the total number of the second contacts 224 of all the second circuit paths 224 will be the same as the number of the haptic actuators 230. Therefore, the layout of the circuit paths can be simplified to reduce the necessary layout area and further reduce the size of the input device.

Figure 5C:
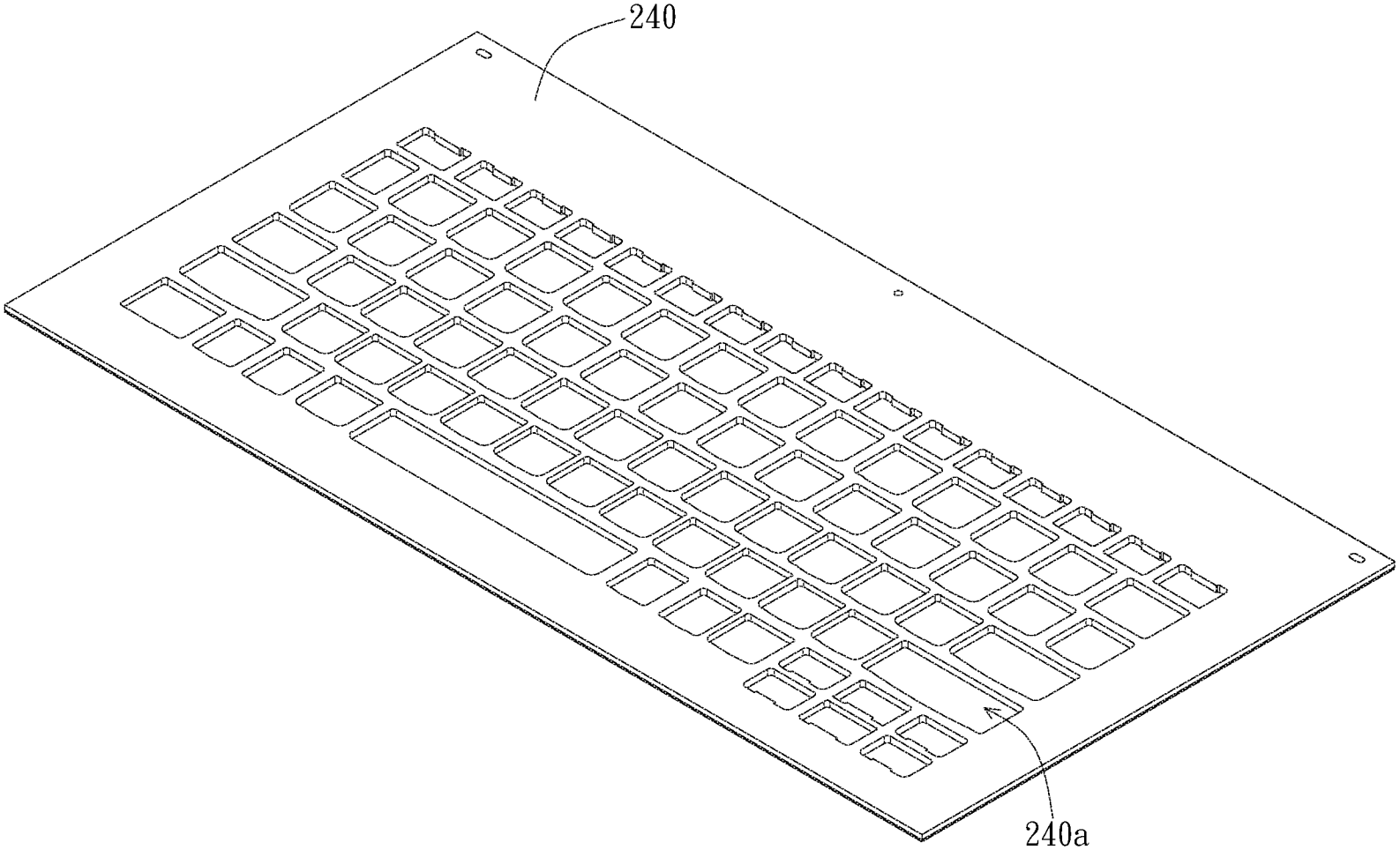
FIG. 5C is a schematic view of the support layer of FIG. 4A.

As shown in FIGS. 4A and 5C, the support layer 240 is disposed between the circuit layer 220 and the cushion layer 250. The support layer 240 has a plurality of openings 240*a* corresponding to the plurality of keycap regions 212, respectively. The plurality of protrusion portions 254 of the cushion layer 250 extend into the plurality of openings 240*a*, respectively. As described above, the hardness of the support layer 240 is preferably larger than the hardness of the cushion layer 250, and the thickness of the support layer 240 is preferably larger than the thickness of the haptic actuator 230 to provide sufficient vibration space for the haptic actuator 230.

Figure 5D:
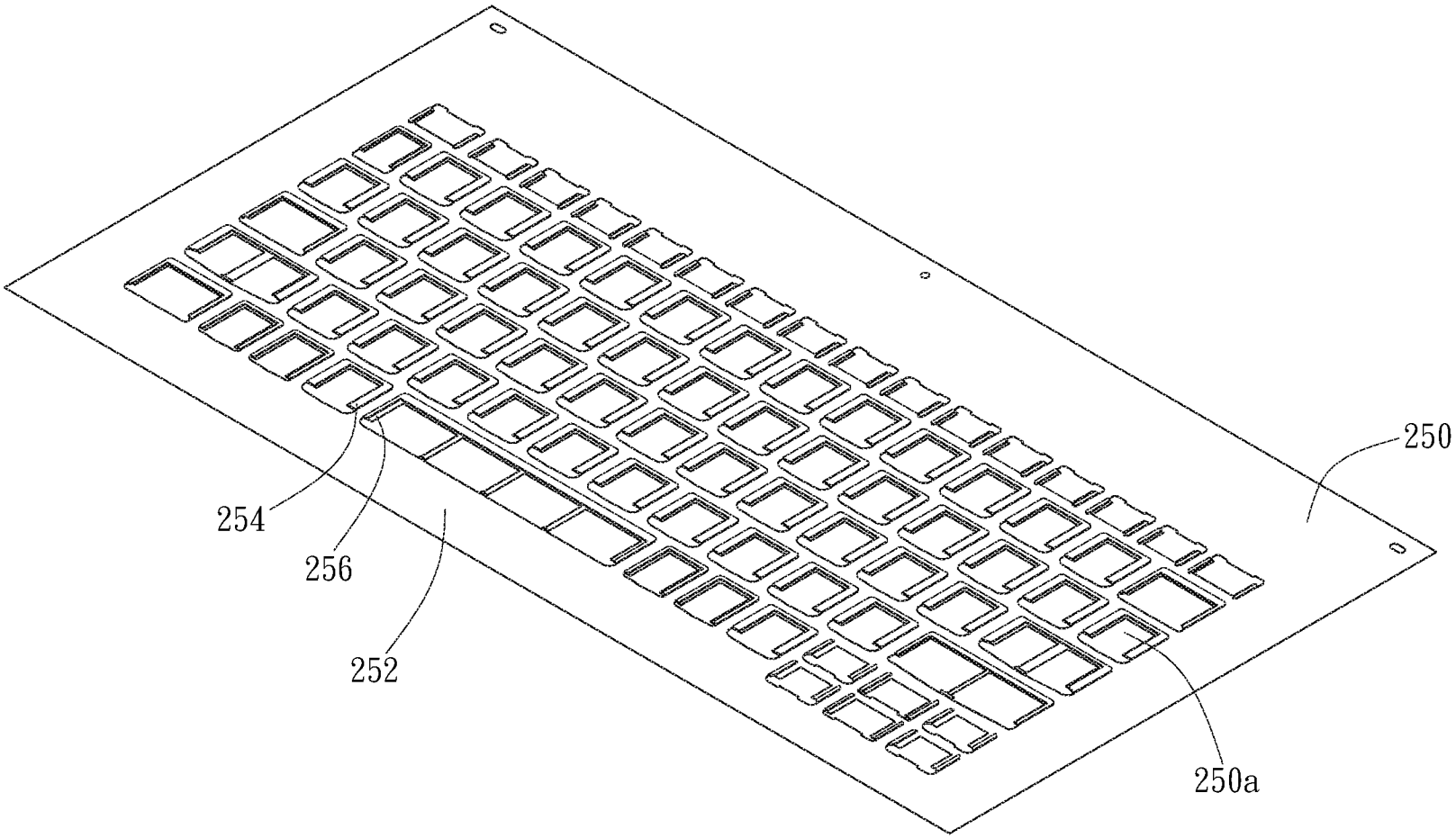
FIG. 5D is a schematic view of the cushion layer of FIG. 4A.

As shown in FIGS. 4A and 5D, the cushion layer 250 is disposed under the circuit layer 220. Corresponding to the keycap regions 212, the cushion layer 250 has a plurality of accommodation spaces 250*a* for accommodating the plurality of haptic actuators 230. The cushion layer 250 includes a film portion 252 and a plurality of protrusion portions 254. The plurality of protrusion portions 254 are connected together by means of the film portion 252 to form a single cushion layer 250. Similarly, the film portion 252 has a plurality of accommodation areas (e.g. through holes), and the plurality of protrusion portions 254 are correspondingly disposed around the accommodation areas. The protrusion portions 254 extend from the film portion 252 toward the circuit layer 220 to define the accommodation spaces 250*a* over the accommodation areas. When the support layer 240 is disposed on the film portion 252 of the cushion layer 250, the plurality of the protrusion portions 254 extend into the plurality of openings 240*a*, respectively. Moreover, the cushion layer 250 further has a plurality of extension portions 256. The plurality of extension portions 256 extend from the plurality of protrusion portions 254 toward the inner side of the accommodation space 250*a*, respectively. The top surface of the extension portion 256 is preferably lower than the top surface of the corresponding protrusion portion 254. Moreover, the extension portion 256 preferably extends under the lower surface of the corresponding haptic actuator 230, so that the haptic actuator 230 at least partially abuts on the top surface of the extension portion 256.

Moreover, as shown in FIGS. 4A and 4B, the plurality of sensing units 262 can be integrated into a single sensor layer 260. The plurality of sensing units 262 can be controlled by a single control circuit 270 to simplify the manufacturing and assembly processes, but not limited thereto.

The operation is similar to that of FIG. 1D or 2D. For example, when an external force is applied to one of the keycap regions 212 and delivered downwardly through the force-transferring portion of the corresponding cushion layer 250 (e.g. the protrusion portion 254 and/or the extension portion 256) through at least one of the above two paths to trigger the corresponding one of the sensing units 262. The triggered sensing unit 262 outputs the trigger signal T to the control circuit 270. The trigger signal T not only serves as a sensing signal for inputting the corresponding character or command of the pressed keyswitch structure, but also as an indicating signal for generating the driving signal D, so that the control circuit 270 can output the driving signal D to the corresponding haptic actuator 230 upon receiving the trigger signal T. When the haptic actuator 230 receives the driving signal D from the control circuit 270 through the corresponding circuit paths of the circuit layer 220, such as the first circuit path 222 and the second circuit path 224, the driven haptic actuator 230 vibrates within the accommodation space 250*a* to provide the vibration feedback of confirming the key-pressing operation.

Moreover, as shown in FIG. 6, the adhesive layer 280 is disposed on a bottom surface of the keycap layer 210 outside the keycap region 212 to adhere the peripheral region 214 of the keycap layer 210 to the circuit layer 220. Similarly, the adhesive layer 280 is disposed only on a portion of the bottom surface of the keycap layer 210 that corresponds to the peripheral region 214. That is, the bottom surface of the keycap region 212 is not disposed with the adhesive layer 280, so that the keycap region 212 and the portion of the circuit layer 220 that corresponds to the keycap region 212 are not physically adhered together, i.e. the keycap region 212 and the portion of the circuit layer 220 that corresponds to the keycap region 212 has a gap therebetween. As such, when the haptic actuator 230 is driven to vibrate by the driving signal, the kinetic energy loss of the haptic actuator 230 occurring during vibration can be reduced. That is, if the entire keycap layer 210 is adhered to the circuit layer 220, the "load" of the haptic actuator 230 is increased and the vibration of the haptic actuator 230 becomes more difficult, resulting in the increase in kinetic energy loss. Moreover, the remaining components of the input device 10, such as the circuit layer 220, the cushion layer 250, and the sensor layer 260, can be connected by adhesives to fix the relative positions among the components.

Compared to prior arts, the input device and the keyswitch structure of the invention have the adhesive layer disposed outside the keycap region (i.e. only on the peripheral region) to effectively reduce the kinetic energy loss occurring during the vibration of the haptic actuator. Moreover, the input device and the keyswitch structure of the invention can improve the vibration effect, the external appearance, the operation convenience or reduce the cost by optimizing the configuration of the keycap layer or selecting the materials of the keycap layer.

Although the preferred embodiments of the invention have been described herein, the above description is merely illustrative. The preferred embodiments disclosed will not limit the scope of the invention. Further modification of the invention herein disclosed will occur to those skilled in the respective arts and all such modifications are deemed to be within the scope of the invention as defined by the appended claims.

What is claimed is:

1. A keyswitch structure, comprising:

a keycap layer having a keycap region and a peripheral region adjacent to the keycap region;

a circuit layer disposed under the keycap layer;

a haptic actuator electrically connected to the circuit layer;

a supporting structure layer disposed under the circuit layer, the supporting structure layer having an accommodation space for accommodating the haptic actuator, the supporting structure layer comprising a cushion layer having a protrusion portion and a support layer having an opening corresponding to the keycap region, the protrusion disposed around the accommodation space and protruding into the opening; and an adhesive layer disposed between the keycap layer and the circuit layer corresponding to only the peripheral region.

2. The keyswitch structure of claim 1, wherein the thickness of the keycap layer at the keycap region is larger than the thickness of the keycap layer at the peripheral region.

3. The keyswitch structure of claim 1, wherein the keycap layer has a recessed groove formed on a lower surface of the keycap layer corresponding to the keycap region; a filling material different from the material of the keycap layer fills in the recessed groove.

4. The keyswitch structure of claim 1, wherein the keycap layer has a character or pattern formed on an upper surface of the keycap layer to define the keycap region.

5. An input device, comprising:

a plurality of the keyswitch structures of claim 1, wherein the plurality of the keycap regions of the keyswitch structures are connected by the peripheral regions to form an unitary keycap layer; the adhesive layer is disposed on the peripheral regions outside the keycap regions.

6. The keyswitch structure of claim 1, wherein the keycap layer has a positioning portion formed on a lower surface of the keycap layer corresponding to the keycap region; the circuit layer has a positioning hole; the positioning portion protrudes from the lower surface of the keycap layer to be positioned in the positioning hole.

7. The keyswitch structure of claim 6, wherein the positioning portion protrudes from the lower surface of the keycap layer to define a space; the haptic actuator is received in the space.

8. The keyswitch structure of claim 1, wherein the hardness of the circuit layer is larger than the hardness of the keycap layer, and the thickness of the circuit layer is smaller than the thickness of the keycap layer.

9. The keyswitch structure of claim 8, wherein the circuit layer is made from a polyethylene terephthalate (PET) film and a circuit is formed on the PET film; the keycap layer is made from a material selected from the group consisting of polyurethane (PU), thermalplastic polyurethane (TPU), leather, textile, and silicone.

10. The keyswitch structure of claim 9, wherein the thickness of the circuit layer is in a range of 0.05 mm to 0.5 mm; the thickness of the keycap layer is in a range of 0.1 mm to 2 mm.

11. A keyswitch structure, comprising:

a keycap layer having a keycap region and a peripheral region adjacent to the keycap region, the keycap layer having a positioning portion formed on a lower surface of the keycap layer corresponding to the keycap region;

a circuit layer disposed under the keycap layer, the circuit layer having a positioning hole, the positioning portion protruding from the lower surface of the keycap layer to be positioned in the positioning hole;

a haptic actuator electrically connected to the circuit layer;

a supporting structure layer disposed under the circuit layer, the supporting structure layer having an accommodation space for accommodating the haptic actuator; and an adhesive layer disposed between the keycap layer and the circuit layer corresponding to only the peripheral region.

12. The keyswitch structure of claim 11, wherein the positioning portion protrudes from the lower surface of the keycap layer to define a space; the haptic actuator is received in the space.

* * * * *